United States Patent [19]

Vidal et al.

[11] Patent Number: 5,004,376

[45] Date of Patent: Apr. 2, 1991

[54] FACING SYSTEM

[75] Inventors: Henri Vidal, 8 Bis, Boulevard Maillot, 92200 Neuilly-sur-Seine, France; Santiago Muelas-Medrano, Madrid, Spain; Pierre Segrestin, St Cyr L'Ecole, France

[73] Assignee: Henri Vidal, Neuilly-sur-Seine, France

[21] Appl. No.: 358,619

[22] Filed: May 30, 1989

[30] Foreign Application Priority Data

Jun. 3, 1988 [GB] United Kingdom ..... 8813146

[51] Int. Cl.[5] ..... E02D 29/02; E02D 17/00

[52] U.S. Cl. ..... 405/284; 405/258

[58] Field of Search ..... 405/284, 285, 286, 287, 405/258, 262

[56] References Cited

U.S. PATENT DOCUMENTS

| | | | |
|---|---|---|---|
| 4,074,538 | 2/1978 | Janus | 405/284 X |
| 4,557,634 | 12/1985 | Vidal | 405/284 X |
| 4,661,023 | 4/1987 | Hilfikey | 405/262 |
| 4,668,129 | 5/1987 | Babcock et al. | 405/284 |
| 4,671,706 | 6/1987 | Giardini | 405/286 |

FOREIGN PATENT DOCUMENTS

| | | | |
|---|---|---|---|
| 58731 | 9/1982 | European Pat. Off. . | |
| 115912 | 8/1984 | European Pat. Off. . | |
| 2441216 | 3/1976 | Fed. Rep. of Germany . | |
| 2619274 | 11/1976 | Fed. Rep. of Germany . | |
| 2744473 | 4/1979 | Fed. Rep. of Germany . | |
| 2908578 | 9/1980 | Fed. Rep. of Germany . | |
| 3022029 | 12/1981 | Fed. Rep. of Germany . | |
| 3042967 | 7/1982 | Fed. Rep. of Germany . | |
| 8202549 | 7/1982 | Fed. Rep. of Germany . | |
| 3103849 | 9/1982 | Fed. Rep. of Germany | 405/284 |
| 3201601 | 7/1983 | Fed. Rep. of Germany . | |
| 1166812 | 11/1958 | France . | |
| 1562367 | 2/1969 | France . | |
| 2409350 | 7/1979 | France | 405/284 |
| 2435661 | 4/1980 | France . | |
| 2555213 | 5/1985 | France . | |
| 2575200 | 6/1986 | France . | |
| 2575201 | 6/1986 | France . | |
| 61-490245 | 3/1986 | Japan . | |
| 635639 | 4/1983 | Switzerland . | |

*Primary Examiner*—Dennis L. Taylor

*Attorney, Agent, or Firm*—Burns, Doane, Swecker & Mathis

[57] ABSTRACT

A facing system for a frictionally stabilized earth structure comprises an assembly of facing units each having a sloping facing panel with a substantially horizontal upper edge and a lower edge situated rearward of said upper edge and substantially parallel thereto, the facing panel being supported by a pair of laterally spaced side panels. The facing units are assembled to form a series of superimposed substantially horizontal tiers wherein the sloping facing panels in the tiers are laterally spaced and are positioned vertically above corresponding lateral spaces between facing panels in the tier below, whereby earth immediately behind the structure in contact with the facing panels, forms an open sloping surface from the lower edge of each facing panel through the space in the tier immediately below to the upper edge of the facing panel vertically below the space, the slope of the surface being less than the angle of repose of the earth. The side panels on each of each said facing panel restrain lateral movement of the earth of the slope and are provided with a device for attachment to frictional stabilizing members embedded in the earth of the structure.

11 Claims, 4 Drawing Sheets

FIG. 1
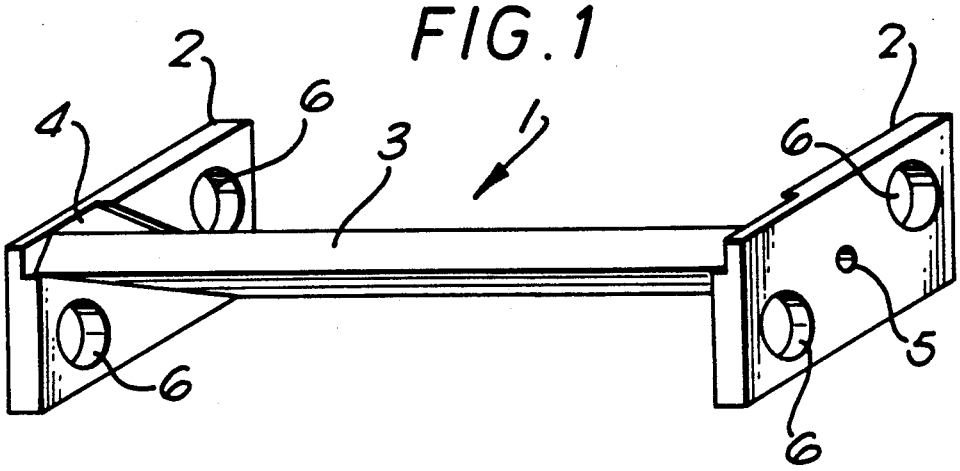
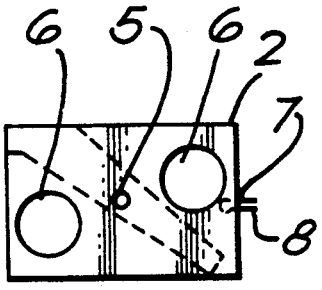
FIG. 2
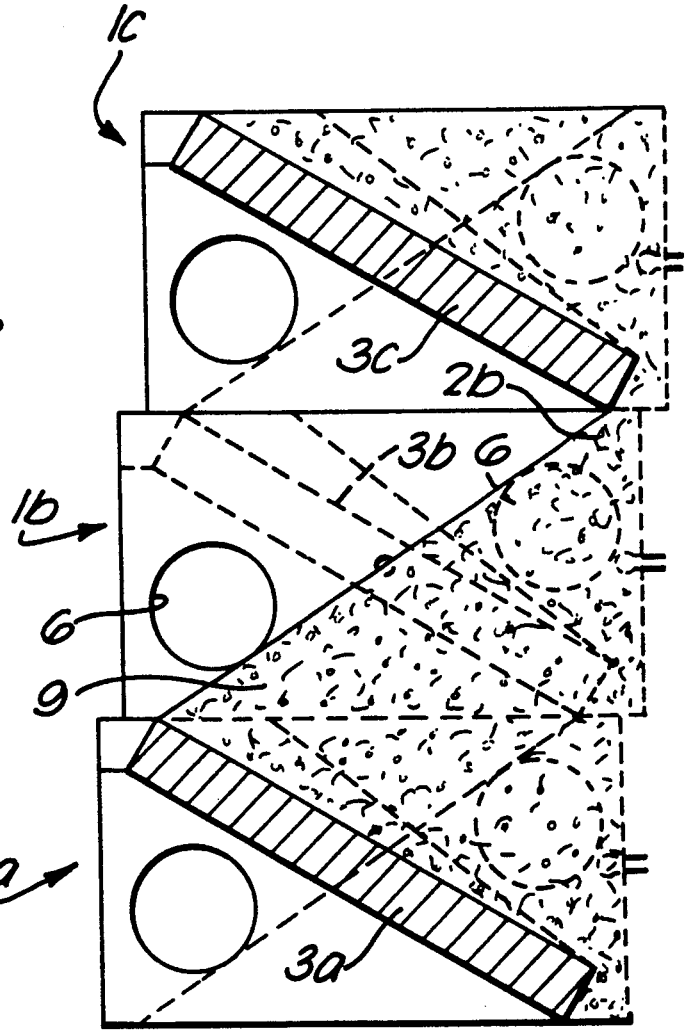
FIG. 3

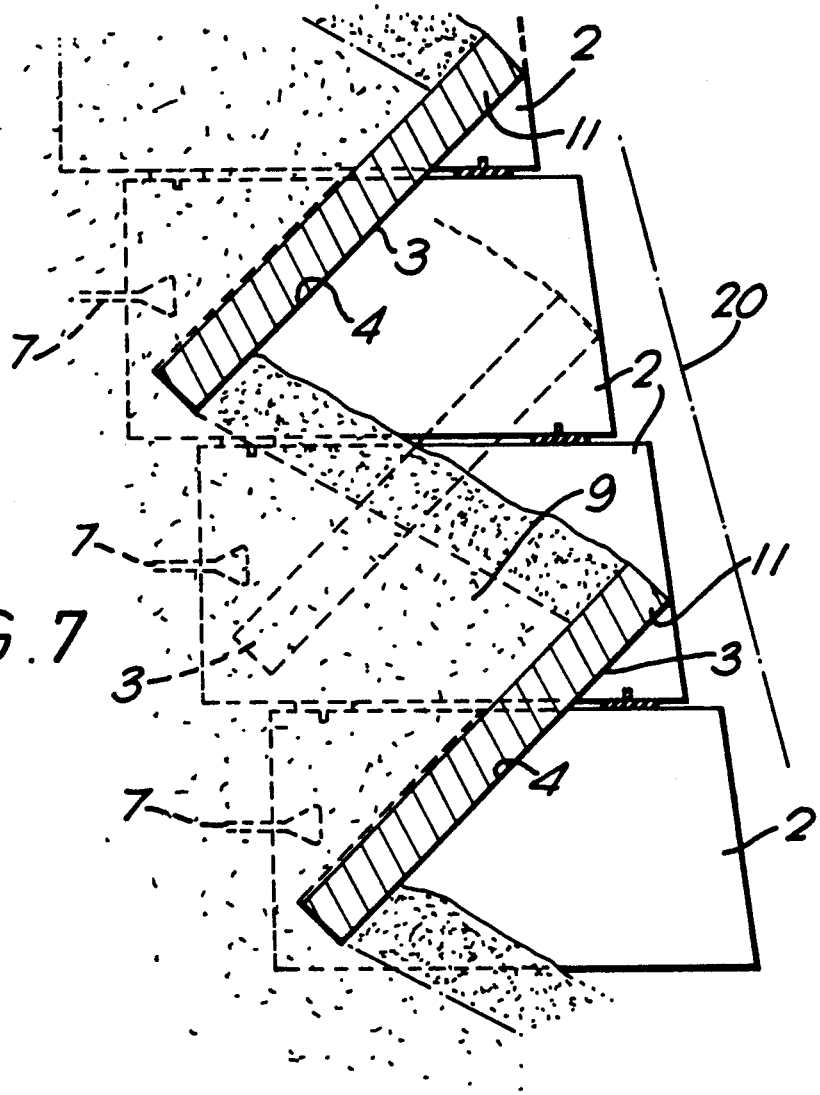
FIG. 7
FIG. 8
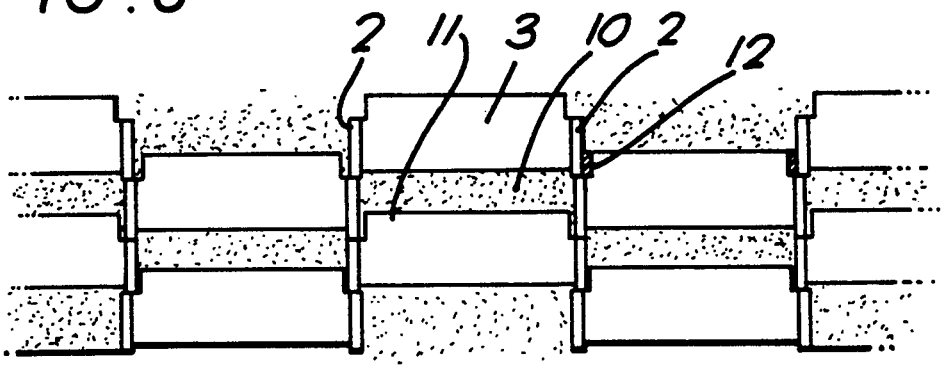

FACING SYSTEM

FIELD OF THE INVENTION

The present invention relates to a facing system for a frictionally stabilised earth structure.

BACKGROUND OF THE INVENTION

U.S. Pat. No. 3421326 of Henri Vidal describes earth structures including retaining wals wherein stability is achieved by compacting successive layers of earth into frictional contact with stabilising members. In this way, the frictional forces between the stabilising members and the adjacent earth particles, and between the earth particles themselves, resist failure caused by lateral earth movement and the resulting tensile forces in the stabilising members, which inevitably have some measure of elasticity, permit slight elastic deformation of the stabilised earth mass thereby enhancing its stability. This technique enables retaining walls for embankments and the like to have at least one substantially vertical face and such a face will normally be clad with a facing system which, in order to conform to small movements created by the above compacting procedure and to accommodate the small elastic or even permanent movements of the structure permitted by the stabilisation technique, are preferably flexible in the plane of the face. In general, such flexibility can be provided by facing panels attached to the stabilising members which are arranged accurately to terminate at the vertical face concerned.

Such panel facing systems provide a high level of architectural finish and satisfactorily resist erosion of the earth of the retaining wall. However, there is a general demand in respect of all retaining wall systems for architectural effects involving growing plants which not only provide an attractive, softer surface appearance but may also serve to absorb sound in urban traffic environments and at airports.

Such systems contrive to provide areas of exposed earth in an otherwise fully clad facing, commonly by incorporating box-like sections into the wall or by constructing a caisson-type gravity wall with exposed earth areas. However, such walls tend to use significantly more reinforced concrete or similar materials than a conventional flat facing, particularly the relatively thin facing systems used in the frictional stabilising technique described above.

OBJECTS AND SUMMARY OF THE INVENTION

One object of the present invention is to provide a facing system for a frictionally stabilised earth structure with exposed plant-growth areas which has the earth retaining capability and flexibility of the more conventional fully clad facing systems without greatly increasing the cost of facing materials.

Another objective of the invention is to provide such a facing system in a form which can be prefabricated in a factory and readily transported to the construction site.

According to one aspect of the present invention we provide a facing system for a frictionally stabilised earth structure comprising an assembly of sloping facing panels each of which has a substantially horizontal upper edge and a lower edge situated rearward of said upper edge and substantially parallel thereto. Means are provided to support said facing panels to form a series of superimposed substantially horizontal tiers wherein the sloping facing panels in said tiers are laterally spaced and are positioned vertically above corresponding lateral spaces between facing panels in the tier below, whereby earth immediately behind said structure in contact with said facing panels, forms an open sloping surface from the lower edge of each facing panel through the space in the tier immediately below to the upper edge of the facing panel vertically below said space, the slope of said surface being less than the angle of repose of the earth. Earth retaining means are provided on each side of each said facing panel to restrain lateral movement of the earth of said slope, said panels and/or said support means being provided with means for attachment to frictional stabilising members embedded in the earth of said structure.

The support means for the sloping facing panels are conveniently side panels lying perpendicular to the plane of the facing which will be in contact with all or part of side edges of the facing panels. Such side panels will normally also serve as the earth retaining means preventing lateral movement of the earth.

According to another aspect of the invention we provide a facing unit comprising a substantially rectangular facing panel secured perpendicularly to two substantially rectangular side panels, the shorter edges of said facing panel being in contact with said side panels at an angle to the upper and lower edges of said side panels.

According to a further aspect of the invention we provide a facing system for a frictionally stabilised earth structure, comprising an assembly of facing units as described above, the facing panel of each unit sloping with its upper edge forward of its lower edge. The units are assembled in a series of superimposed horizontal tiers in which tiers each unit is spaced from the two laterally adjacent units and the side panels of the units of each tier are supported by the upper surfaces of the side panels of the units of the tier below, sloping facing panels in a superimposed tier lying vertically above spaces between laterally adjacent sloping facing panels of the tier below, and said units being provided with means for attachment to a frictional stabilising members embedded in the earth of said structure.

According to a still further feature of the invention we provide a frictionally stabilised earth structure comprising a facing system as described above, the facing system being attached to frictional stabilising members embedded in the earth of said structure.

The sloping facing panels and side panels of the above system will normally be made of reinforced concrete. The side panels and the sloping facing panels of the above units will normally be substantially flat slabs and in a preferred embodiment of the invention they may be provided separately and assembled into the units, conveniently at the construction site. Such flat elements lend themselves to transport in that they may be readily stacked, in contrast with completed units of more complex shape and are particularly simple to produce in large numbers by moulding.

Assembly of the units from separate flat panels is advantageously effected by bolting. The side panels may thus be provided with appropriate holes and the facing panels may have appropriately positioned threaded holes, for example provided by coil inserts. It is also possible to provide the facing panels with integral bolts, the inner ends of which are embedded in the material of the panel and which extend sufficiently far to pass through holes in the side panels whereby securing nuts may be attached. A single bolt on each end of the facing panel is normally sufficient to secure the assembled unit, particularly where the panels additionally cooperate with the side panels to restrict movement, but two such bolts may be provided. It is preferred to provide each side panel with a groove which receives and partly secures one side edge of the respective facing panel at the designed slope. Such a groove may be about 4 cm in depth and can usefully be substantially oversized in relation to the dimensions of the cooperating end of the facing panel to simplify assembly. Such a groove may advantageously be wider at the top than the bottom, again to facilitate assembly, the positioning of bolts and holes in the panels determining the precise slope of the facing panel.

The means for attachment of the units to stabilising members embedded in the earth may conveniently be lugs or other metal plates extending rearwards from each of the side panels, such lugs or plates having holes to take securing bolts. The most preferred stabilising members are strips, normally of corrosion resistant steel, e.g. galvanised steel, provided with a hole at the end terminating at the facing adapted to receive the securing bolts referred to above. Such strips are described in our United Kingdom Patent No. 1563317. Advantageously, the stabilising strips are thickened at the region of the said hole to resist tensile forces and possible corrosion; the lugs or plates on the side panels of the facing units are advantageously in closely spaced pairs such that the end of the stabilising strip can be inserted therebetween to receive a bolt passing through the three aligned holes. Such paired lugs or plates can conveniently be provided by a U-shaped strip of galvanised steel embedded in the side panels, advantageously being so bent that the base of the U- section is expanded to resist pulling out of the member from the concrete of the panel.

The units may be stacked to provide a substantially vertical facing or may be slightly displaced to provide an angled or battered facing. Since the units are normally individually secured to stabilising members, it is not necessary to secure the units together and they will, in general, simply be stacked in the formation stated above, which be likened to the arrangement of the black squares of a chessboard. Normally semi-flexible rubber (or resin bonded cork) pads will be placed between the superimposed side panels.

In such an assembly, it will be appreciated that earth slopes provided by the alternate spaces between the units are adapted to receive plants. Since the bottom of the facing panel of the unit above such a space is substantially rearward of the top of the facing panel of the unit immediately below, as indicated above, the exposed earth in the space will be at an angle to the horizontal which in order to avoid loss of earth from such a slope, should not be significantly greater than the angle of repose of the earth, even though plant growth will eventually partially stabilise the slope. This angle may in general vary between $\tan^{-1} 0.4$ and $\tan^{-1} 0.8$ to the horizontal, and is preferably about $\tan^{-1} 0.67$. This consideration is an important factor in determining the dimensions of the facing units and the slopes of the front panels, which may for example be arranged substantially perpendicularly to the earth slopes as mentioned hereinafter.

A major factor in the design of the units is the requirement to minimise the amount of concrete in the overall facing system and, if possible, approximate this to that in a corresponding flat facing system. It is also necessary to ensure that the exposed earth is adequately contained and that there are no significant gaps through which earth could be eroded. In one embodiment of the system, the side edges of each facing panel engage with the side panels approximately along a diagonal of the latter. In such a case, for production of a substantially vertical facing, i.e. with the units vertically stacked without rearward displacement of the upper units, the angle of the facing panels to the horizontal is advantageously about $\tan^{-1} 0.6$. Such arrangements can ensure that the slope of the exposed earth does not exceed the angle of repose while substantially keeping the amount of concrete in the facing to a minimum. If the angle of the facing panels is substantially less than about $\tan^{-1} 0.6$, it will be appreciated that the length of the diagonal of each side panel will have to be greater, so that not only will the top to bottom dimension of the front panels be greater but the side panels will also be longer from front to back, thereby using more concrete. Such arrangements have the advantage of providing larger planting areas, although in view of the smaller slope of the facing panels the rear parts of such planting areas tend to be undesirably sheltered from rain.

It is however, possible for the upper edges of the facing panels to project above the upper edges of the side panels, thus making the vertical elevation of each facing panel greater than that of each of the exposed earth sections. This permits the earth in the exposed sections to be raised at the rear to a level above the bottom edge of the vertically adjacent facing panel without exceeding the angle of repose, thus providing a margin fo security against erosion of soil in the region of that lower edge where soil from above might otherwise 'flow' under the panel. Alternatively, the lower edges of the facing panels may project below the lower edges of the side panels to produce essentially the same effect. The sections of the facing panel which project upwards or downwards in this way will normally not engage with the side panels of the vertically adjacent units and where the panel is inset into a groove into the side panels to which it is bolted, the projecting section can be made narrower than the inset part to avoid such engagement. To prevent earth from eroding between such projecting sections and the vertically adjacent side panels, an insert of geotextile or similar material may be introduced. The gap may be as large as 4 or 5 cm (particularly when the facing is curved as discussed later) so that the insert may sometimes be a small block of concrete.

Where it is intended that the facing shall slope backwards, the tops of the facing panels in any tier of facing units can be rearward of the tops of the facing panels immediately below.

If, in such a structure, the slope of the front panels is unaltered, the height of the panels, i.e. their vertical elevation, may be reduced: the corresponding increase in the vertical distance between the bottom of an upper panel and the top of that below is compensated by the increased horizontal spacing thus maintaining the angle of the earth slope. Alternatively, the angle of the facing panels to the horizontal may be increased, while maintaining their vertical elevation, thus compensating for the increase in rearward horizontal spacing and again maintaining the angle of the earth slope.

Designing the facing panels to project beyond the side panels thus increasing their vertical elevation permits the angle of the facing panels to the horizontal to be increased while permitting the slope of the exposed earth to remain not greater than the angle of repose. This enables the facing panels to be substantially perpendicular to the sloping earth surfaces, thereby increasing the depth of soil near the front of the panel and the ability to collect rainwater for irrigation, both factors assisting the growth of plants on the exposed earth areas. In general, depending on the extent to which the facing panels project beyond the side panels and the overall angle or batter of the facing system, the angle of the facing panels to the horizontal may be between $\tan^{-1} 0.4$ and $\tan^{-1} 2.5$, preferably between $\tan^{-1} 0.45$ and $\tan^{-1} 1.5$.

In such a backward sloping structure, the front edges of the side panels may slope backwards at the same angle as the overall slope of the facing, thereby aligning them in the vertical direction.

The facing panels may typically have a lateral extent or width of 2.0 m, a height of 0.8 m and a thickness of 0.1 m. By increasing the width of the facing panels fewer support means at the panel side edges are required for a given width of structure, and thus there may be savings in the material such as concrete which is used. However, the width of the facing panels is limited by the requirement to avoid an excessive mid-span bending moment and ease of transportation.

It will be appreciated that the simple stacking procedure used to assemble the facing system of the invention permits the facing to be curved. The side panels of units in a superimposed tier may be angled slightly with respect to the side panels of a lower tier on which they rest, provided a sufficient area of contact exists for the side panels to maintain their supporting function. One way of building a curved facing is to vary the angle of the facing panels with respect to the supporting side panels by using two bolts to form each facing panel-to-side panel connection, with washers of suitable thickness located on the bolts to achieve the desired angle. To achieve sharper curvatures it may be desirable to use shorter lengths of facing panels.

BRIEF DESCRIPTION OF THE DRAWINGS

Some preferred embodiments of the invention wil now be described by way of example and with reference to the accompanying drawings in which:

FIG. 1 is a perspective view of a facing unit for use in a facing system in accordance with the invention;

FIG. 2 is an elevation view of a side panel of the facing unit shown in FIG. 1;

FIG. 3 is a vertical section through the facing system;

FIG. 7 is a vertical section through a fifth embodiment; and

FIG. 8 is a front elevation of part of the facing system of FIG. 7.

DETAILED DESCRIPTION OF THE PREFERRED EMBODIMENTS

Figures 4, 5:
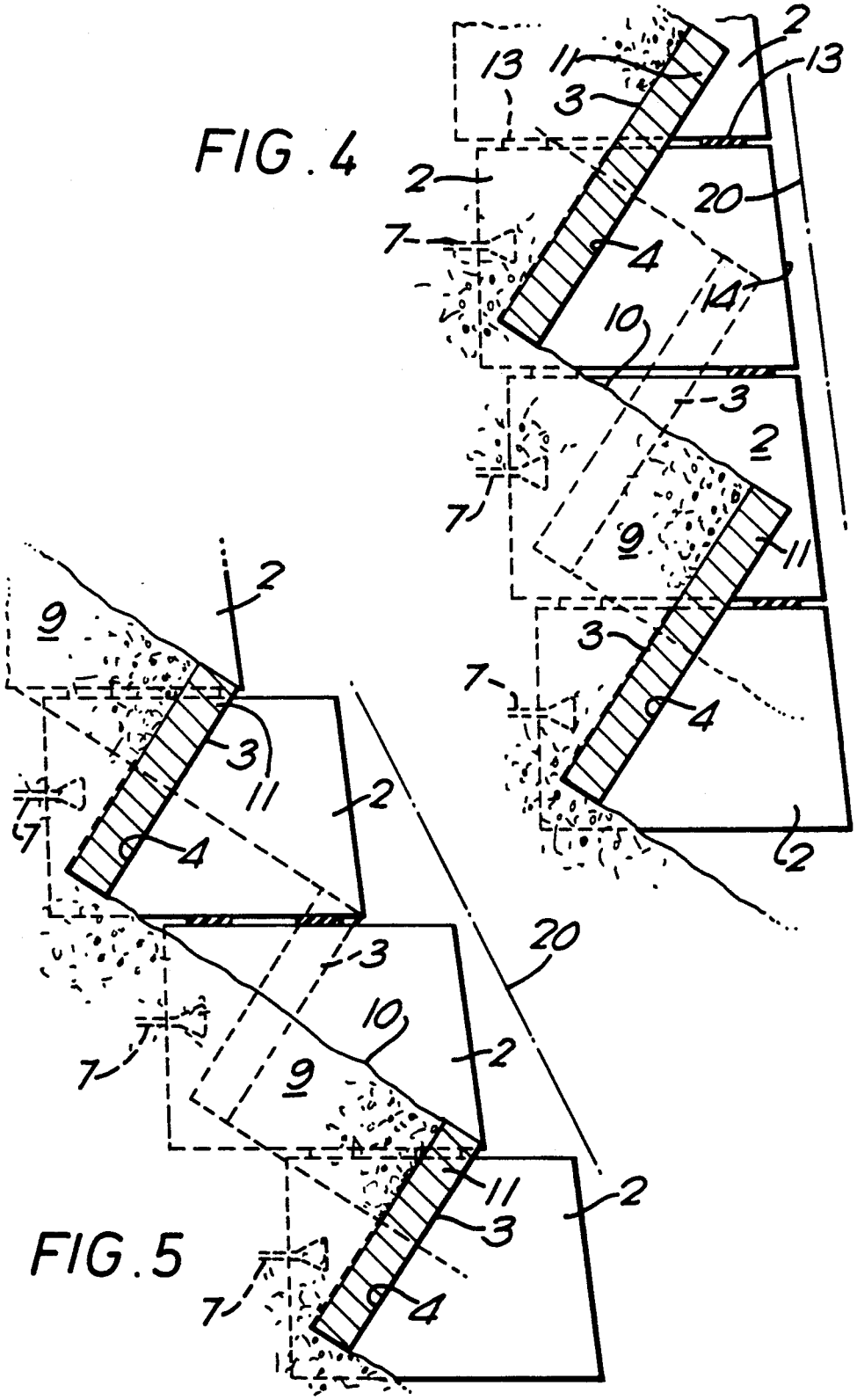
FIG. 4 is a vertical section through a second embodiment of facing system in accordance with the invention.
FIG. 5 is a vertical section through a third embodiment.

Referring to FIGS. 1 and 2 a reinforced concrete facing unit 1 comprises a pair of laterally spaced side panels 2 which support a facing panel 3. The side panels are rectangular in shape and are each provided with a recessed groove 4 extending between diagonally opposite corners for receiving the ends of the facing panel 3 which is also of rectangular shape. The grooves 4 are of tapered configuration, being widest at the upper, front corner of the side panel, so as to assist location of the facing panel in the supporting grooves. Midway of the length of each groove 4 the side panels 2 are formed with a hole 5 for receiving a bolt which engages in a coil insert (not shown) located at the ends of the associated facing panel. The side panels 2 are also provided with a pair of circular openings 6 disposed on opposite sides of the groove for the purpose of reducing the amount of concrete used to form the panels. A U-shaped strip 7 of galvanised steel is embedded in the rear of the side panels to provide a pair of rearwardly projecting lugs 8 to which stabilising members may be attached.

FIG. 3 shows three facing units 1*a*, 1*b* and 1*c* stacked on top of each other to form a facing system at the front of a body of earth backfill 9. The lower and upper facing units 1*a* and 1*c* each have a facing panel 3*a* and 3*c* with an exposed earth slope 10 extending between the top of the lower facing panel 3*a* and the bottom of the upper facing panel 3*c*. The side panel 2*b* of the middle facing unit 1*b* supports a facing panel 3*b* on its remote side. Each facing unit is located slightly rearwardly of the one below so that the front of the facing overall slopes to the rear at an angle of $\tan^{-1} 0.1$ to the vertical. It will be noted that the rear openings 6 formed in the side panels are located such that earth is disposed on each side thereof, whilst the front openings 6 are open to air on each side thereof. Thus the openings 6 communicate either earth to earth or air to air and thus avoid an earth to air communication which would permit earth to spill from the opening. Whilst the illustrated openings are circular, any convenient shape may be selected.

The facing panels shown in FIGS. 1 to 3 may typically have a lateral extent (width) of 2.0 m, a height of 0.8 m and a thickness of 0.1 m. The side panels may have a length (front to rear) of 0.85 m, a height of 0.5 m and a thickness of 0.1 m. The facing panels are arranged along the diagonal of the side panels and thus slope at an angle to the horizontal of $\tan^{-1} (0.5/0.85)$, i.e. $\tan^{-1} 0.59$. The earth slope 10 is at a slightly greater angle to the horizontal although not greater than $\tan^{-1} 0.67$.

In the further embodiments the same reference numerals as those of FIGS. 1 to 3 are used to denote corresponding parts and features.

In the embodiments of FIGS. 4 to 8 the facing panels 3 supported in the side panel grooves 4 project upwardly above the upper surface of the side panels. As seen in FIG. 8, the upwardly projecting portion 11 of each facing panel is of reduced width so as to avoid snarling on the side panels of the tier above. The resulting spaces are covered by geotextile inserts 12 to prevent escape of earth.

The facing systems of FIGS. 4 to 8 include resilient e.g. rubber spacer members 13 located between the stacked side panels. These spacer members enable limited vertical movement of the facing to accommodate any settlement of the earth backfill and avoid any spalling of concrete.

Referring in particular to the embodiment of FIG. 4, the exposed earth slope 10 is at an angle of $\tan^{-1} 0.67$ to the horizontal, whilst the facing panels are arranged perpendicularly to the earth slope, i.e. at an angle of $\tan^{-1} 1.5$ to the horizontal. Each side panel is located slightly to the rear of the side panel below such that the overall slope 20 of the facing is $\tan^{-1} 0.1$ to the vertical, and the front surface 14 of each side panel also slopes rearwardly at an angle of $\tan^{-1} 0.1$ to the vertical, so that the front surfaces 14 are aligned with each other.

In the embodiment of FIG. 5 the exposed earth slope 10 is also at an angle of $\tan^{-1} 0.67$ to the horizontal, the facing panels being again perpendicular to the earth slope. This embodiment differs from that of FIG. 4 in that the side panels are stacked such that the overall slope 20 of the facing is $\tan^{-1} 0.5$ to the vertical i.e. the facing slopes backwards to a greater extent. This means that the exposed earth slopes 10 are of greater length than the height of the facing panels, providing an increased planting area.

Figure 6:
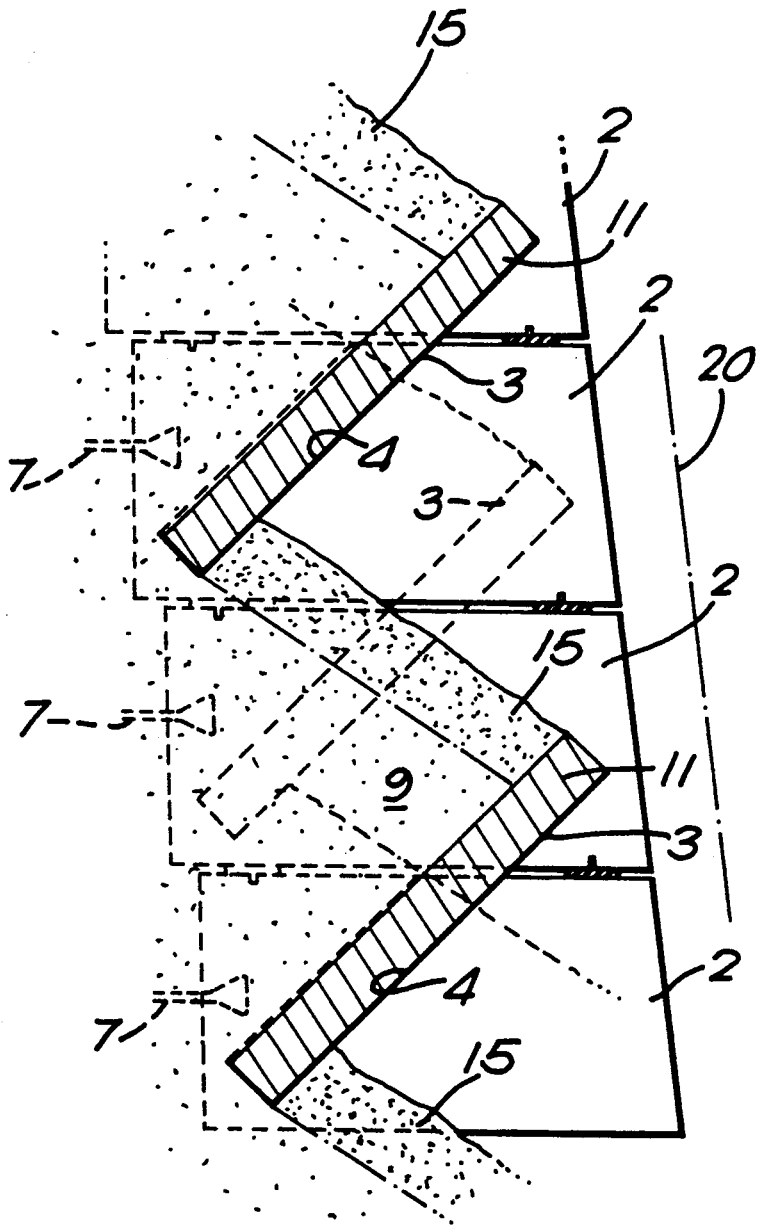
FIG. 6 is a vertical section through a fourth embodiment.

In the embodiment of FIG. 6, the projecting portion 11 of each facing panel projects upwards to a greater extent than in the embodiments of FIGS. 4 and 5, such that the level of the exposed earth slopes 10 are raised, having an extra portion 15. At the rear of these earth slopes the earth is thus above the bottom edge of the vertically above facing panel, thereby tending to prevent flow of soil particles under the bottom edge. In this embodiment the earth slope is again at an angle of $\tan^{-1} 0.67$ to the horizontal, whilst in this instance the facing panels are not perpendicular to the earth slope, but rather are at an angle of $\tan^{-1} 1.0$ to the horizontal. The overall slope 20 of the facing is $\tan^{-1} 0.1$ to the vertical.

The embodiment of FIGS. 7 and 8 is similar to that of FIG. 6 in that an extra earth portion 15 is provided. In this embodiment the earth slope 10 is at a less steep angle i.e. an angle of $\tan^{-1} 0.57$ to the horizontal. The facing panels are at an angle $\tan^{-1} 1.0$ to the horizontal, whilst the overall slope 20 of the facing is $\tan^{-1} 0.25$ to the vertical.

We claim:

1. A facing system for a frictionally stabilized earth structure, said facing system having a front and a rear and comprising: an assembly of sloping facing panels each of which has a substantially horizontal upper edge and a lower edge situated rearward of said upper edge and substantially parallel thereto; means for supporting said facing panels to form a series of superimposed substantially horizontal tiers thereof, the sloping facing panels in said tiers being laterally spaced to define lateral spaces between adjacent facing panels, and the facing panels in said tiers being positioned vertically above corresponding lateral spaces between facing panels in the tier below, whereby earth immediately behind said facing system in contact with said facing panels forms an open sloping surface from the lower edge of each facing panel through the lateral space in the tier immediately below to the upper edge of the facing panel vertically below said lateral space, the slope of said surface being less than the angle of repose of the earth; earth retaining means provided on each side of each said facing panel for restraining lateral movement of the earth of said slope; and said panels and/or said support means being provided with means for attachment to frictional stabilizing members embedded in the earth of said structure.

2. A facing system as claimed in claim 1, wherein the means for supporting the sloping facing panels are side panels lying perpendicular to the plane of the facing and in contact with at least a part of side edges of the facing panels, such side panels also serving as the earth retaining means preventing lateral movement of the earth.

3. A facing system as claimed in claim 2, wherein the facing and side panels are separate flat panels and are connected together by bolts.

4. A facing system as claimed in claim 2 wherein each side panel has a groove which receives and partly secures one side edge of the respective facing panel.

5. A facing system as claimed in claim 4, wherein the groove is wider at the top than the bottom to facilitate assembly.

6. A facing system as claimed in claim 2, wherein the side edges of each facing panel engage with the side panels approximately along a diagonal of the side panels.

7. A facing system as claimed in claim 2, wherein the upper edges of the facing panels project above the upper edges of the side panels.

8. A facing system as claimed in claim 1, wherein the angle of the facing panels to the horizontal is between $\tan^{-1} 0.45$ and $\tan^{-1} 1.5$.

9. A facing system for a frictionally stabilized earth structure, said facing system having a front and a rear and comprising: an assembly of facing units, each of said facing units having two side panels with substantially horizontal upper and lower surfaces extending perpendicular to the facing system and a sloping facing panel therebetween, said facing panel having an upper edge, a lower edge and side edges, the upper edge of the facing panel being forward of the lower edge while the side edges thereof engage with said two side panels, said facing units being assembled in a series of superimposed horizontal tiers, each facing unit in a tier being spaced from laterally adjacent units and the side panels of the facing units of each tier being supported by upper surfaces of the side panels of the facing units of the tier below, sloping facing panels in a superimposed tier lying vertically above spaces between laterally adjacent sloping facing panels of the tier below, and said facing units being provided with means for attachment to frictional stabilizing members embedded in the earth of said structure.

10. A frictionally stabilised earth structure comprising a facing system as claimed in claim 9, the facing system being attached to frictional stabilising members embedded in the earth of said structure.

11. A facing system for earth structure, said facing system having a front and a rear and comprising: an assembly of facing units, each of said facing units having two side panels with substantially horizontal upper and lower surfaces and a sloping facing panel positioned therebetween, said facing panel having an upper edge, a lower edge and side edges, the upper edge of the facing panel being forward of the lower edge while the side edges thereof engage with said two side panels, said facing units being assembled in a series of superimposed horizontal tiers, each facing unit in a tier being spaced from laterally adjacent facing units and the side panels of the facing units of each tier being supported by upper surfaces of the side panels of the facing units of the tier below, and sloping facing panels in a superimposed tier lying vertically above spaces between laterally adjacent sloping facing panels of the tier below.

* * * * *